United States Patent [19]

Holtey et al.

[11] Patent Number: 4,724,431

[45] Date of Patent: Feb. 9, 1988

[54] COMPUTER DISPLAY SYSTEM FOR PRODUCING COLOR TEXT AND GRAPHICS

[75] Inventors: Thomas O. Holtey, Newton, Mass.; Kenneth E. Bruce, Nashua, N.H.

[73] Assignee: Honeywell Information Systems Inc., Waltham, Mass.

[21] Appl. No.: 650,941

[22] Filed: Sep. 17, 1984

[51] Int. Cl.[4] ..... G09G 1/16

[52] U.S. Cl. ..... 340/703; 340/701; 340/747; 340/748

[58] Field of Search ..... 340/721, 703, 745, 748, 340/750, 747

[56] References Cited

U.S. PATENT DOCUMENTS

| | | | |
|---|---|---|---|
| 4,016,544 | 4/1977 | Morita et al. | 340/747 |
| 4,232,311 | 11/1980 | Agneta | 340/703 |
| 4,342,029 | 7/1982 | Hofmanis et al. | 340/703 |
| 4,368,461 | 1/1983 | Komatsu et al. | 340/703 |
| 4,408,200 | 10/1983 | Bradley | 340/731 |
| 4,484,187 | 11/1984 | Braun et al. | 340/721 |
| 4,490,797 | 12/1984 | Staggs et al. | 340/703 |
| 4,574,277 | 3/1986 | Krause et al. | 340/703 |
| 4,613,852 | 9/1986 | Marako | 340/703 |

FOREIGN PATENT DOCUMENTS

| | | | |
|---|---|---|---|
| 2032740 | 5/1980 | United Kingdom | 340/703 |

*Primary Examiner*—Gerald L. Brigance

*Attorney, Agent, or Firm*—Nicholas Prasinos; John S. Solakian

[57] ABSTRACT

The invention pertains to a method and apparatus to provide for the display of characters and graphics in color. The invention includes three bit map memories which store graphics information for different colors, one character generator driven from a text memory for display of text, and an attribute memory for storing display characteristics such as inverse video and blinking. The contents of the bit map and attribute memories and the output of the character generator are used to address a pre-programmed ROM. The output from the ROM is a string of three bit words with each bit stream representing a primary color on a color CRT and being connected to the associated color input to the CRT. Composite graphics and text are displayed on the CRT.

4 Claims, 4 Drawing Figures

COMPUTER DISPLAY SYSTEM FOR PRODUCING COLOR TEXT AND GRAPHICS

BACKGROUND OF THE INVENTION

1. Field of the Invention

This invention relates generally to a computer display system, and more particularly to a display system for combining text and graphics in color.

2. Description of the Prior Art

Graphics and alphanumeric text are displayed usually in many business applications. This permits the display of characters or graphics either simultaneously or individually. In order to highlight and differentiate different graphs presented on one chart, it is desirable to present each graph and/or text in different colors. The prior art utilizes 3 bit map memories for storing the text in red, green and blue in the different bit map memories, as well as 3 bit map memories for storing graphics display. Accordingly, three character generators are normally required for generating text in the different colors. This has the disadvantage of requiring excessive hardware and thereby increasing the cost of the computer display system.

OBJECTS OF THE INVENTION

It is a primary object of the invention to have an improved display system.

It is another object of the invention to have an improved display system having color capability.

It is another object of the invention to have an improved display system for displaying graphics and text in different colors.

SUMMARY OF THE INVENTION

The display system includes three bit map memories for storing pixels (bits) representative of a graphic display image. Each of the three bit map memories is utilized to display graphics in a particular color. Additional colors may be displayed utilizing the contents of each bit map memory, by combining the colors in each bit map memory.

Text information is stored in byte form in a data random access memory (RAM). Additionally, attribute characters are stored in an attribute RAM.

A mixing programmable read-only memory (PROM) receives the pixels in the form of signals from each of the 3 bit map memories as well as the text signals from a data RAM coupled to a character generator. The character generator stores signals of characters that are utilized to generate the text bytes stored in the data RAM.

Attribute signals are also applied to the mixing ROM to provide for low or high intensity of the display or inverting the background of text and graphic color.

It is the purpose of the mixing ROM to receive color graphics signals, monochrome text signals and mode control signals to produce signals to represent pixels for presentation to a color CRT for the display of color graphics and color text either individually or intermixed on the same display CRT.

BRIEF DESCRIPTION OF THE DRAWINGS

The novel features which are characteristic of the invention are set forth with particularity in the appended claims. The invention itself, however, both as to organization and operation may best be understood by reference to the following description in conjunction with the drawings in which:

DESCRIPTION OF THE PREFERRED EMBODIMENT

Figure 1:
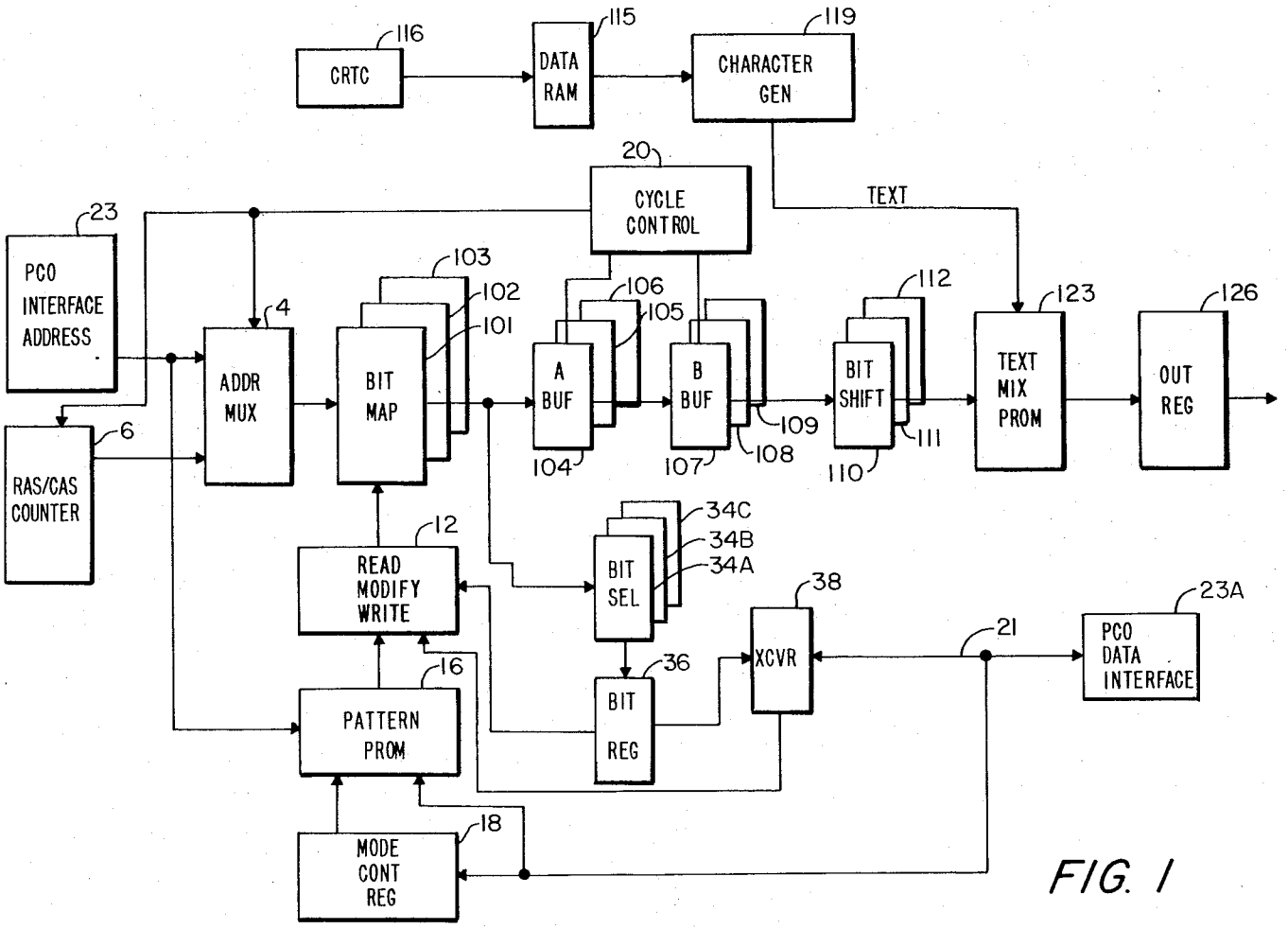
FIG. 1 is a block diagram of the invention.

Referring now to FIG. 1, there is shown a block diagram of the invention. Bit map memories 101, 102, 103 store images of the graphics to be displayed on the display screen. The image stored in bit map memory 101 will be displayed in red; the image stored in bit map memory 102 will be displayed in green; and the image stored in bit map memory 103 will be displayed in blue. Each bit map is a random access memory that contains the screen image of 216,000 pixels (720×300 pixels). Each location in each bit map represents a pixel to be displayed on the monitor in a predetermined color. The monochrome option requires a single plane memory, just one bit per pixel displayed. The color option requires 3 planes of memory, 101, 102, 103, a plane for each of the three basic colors -- red, green and blue. When writing to a color option memory, one or more planes at the addressed pixel position will be written to obtain the designated color. Black is displayed when all the corresponding pixels of three planes equal ZERO. A microprocessor (not shown) controls what is written into the actual bit map memory. Data is written one pixel per write command. Bit map memory 101, 102, 103 is addressed via an address multiplexer 4 from PCO interface address 23 or from row address select/column address select (RAS/CAS) 6. Each bit map memory is made up of 8 64K×1 dynamic RAMS storing 216,000 pixels for display on a CRT (not shown). A pattern PROM 16 stores bits representative of the patterns that may be displayed; i.e., diagonal lines, cross-hatch lines, dotted areas, etc. A mode control register 18 stores mode signals which indicate a replace mode of operation, an OR mode of operation or an exclusive OR mode of operation. Predetermined output signals from pattern PROM 16 are selected in accordance with state of the mode signals from mode control register 18. Eight bits are read from each of bit map memories 101, 102, 103, and are applied to bit select 34 which applies a bit selected from each of said bit map memories to bit map register 36. A transceiver 38 when enabled allows data bits from bit map register 36 to be reflected on data bus 21. Three low order address bits in a read command issued to the color option select which pixel appears in the return data byte. In the case of a write memory operation a full byte of data transferred from the PCO 23 is used to determine what is to be written into the address pixel position of bit map memory. The write command data byte utilizes bits 0, 1 and 2 for pattern select (the three high order bits of an eight word byte); bits 3 and 4 for operations reserved for future use; and bits 5, 6 and 7 for color select. In the color version of the graphics option, bit 5 will write into the red plane, bit 6 into the green plane and bit 7 into the blue plane. Therefore, by the use of these three bits eight colors can be generated.

The output signals of bit map memory 101, 102, 103 are buffered first in A buffers 104, 105, 106 and secondly in B buffers 107, 108, 109; then they are serialized in bit shift registers 110, 111, 112 and the stream of bits applied to text mix PROM 123.

Data RAM 115 stores text to be displayed on a CRT. The data is stored and read under control of CRTC 116. Text in the form of signals read from data RAM 115 are then applied to character generator 119. The output signal from charater generator 119 is then applied to the text mix PROM 123.

Figure 2A:
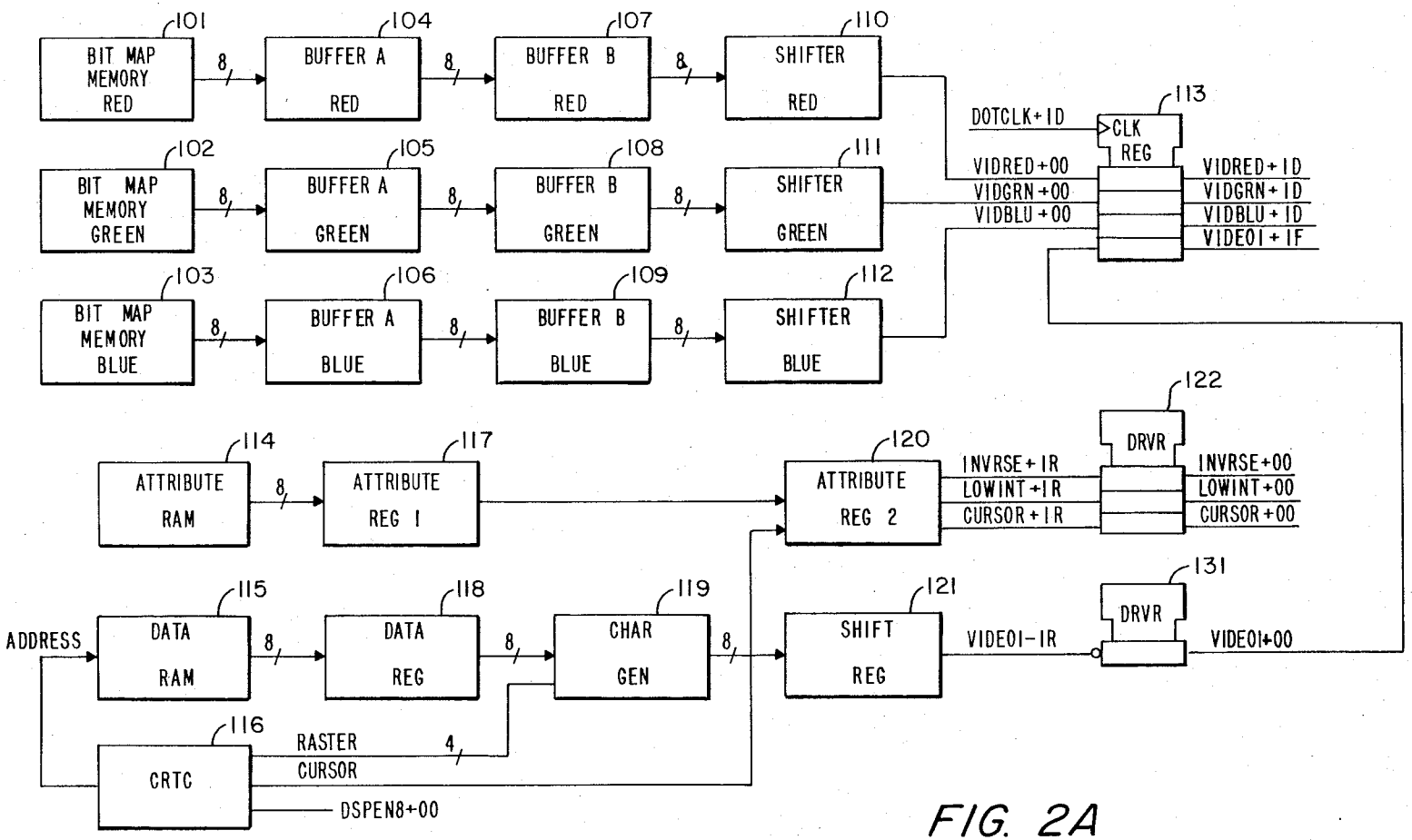
FIGS. 2A and 2B are logic block diagrams of the invention.
Figure 2B:
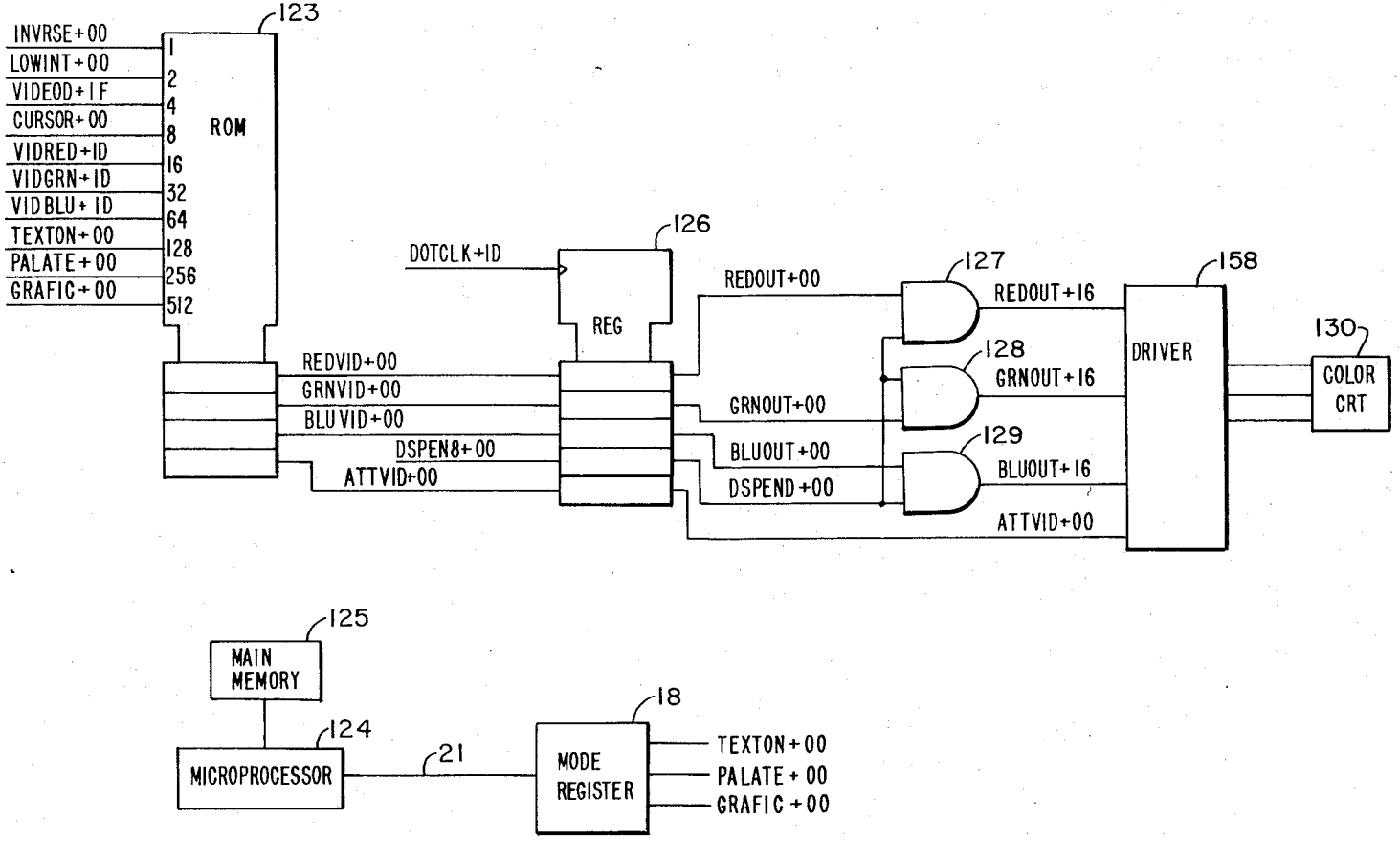

Referring now to FIGS. 2A and 2B, the text is generated in the normal monochrome display manner. The text display codes are in the data RAM 115 and the matching attributes; i.e., blinking, inverse, blanking, etc. are stored in attribute RAM 114. Both the attribute RAM and 114 the data RAM, 115 store 8 bit bytes. The cathode ray tube controller 116 controls the addressing of data RAM 115 by sending sequential addresses to the data RAM 115. The output of data RAM 115 is stored in data register 118. The output of the attribute RAM 114 is stored in attribute register 117. The output of data register 118 is applied to a character generator 119; the output being data bytes to the character generator 119. Four raster signals from cathode ray tube controller 116 are also applied to character generator 119 to address the horizontal lines of each character. The output of character generator 119 is applied to shift register 121. Register 121 is a serial shift register to serialize the text for CRT display. It has the same function as shift register 110, 111 and 112 for color.

The signal VIDEO1-1R from shift register 121 is applied to driver 131, which inverts the video signal to VIDEO1+00 and is then stored in register 113. There are three attribute signals from attribute register 120 INVRSE+1R, LOWINT+1R and CURSOR+1R; these signals are applied to driver 122 which generates signals INVRSE+00, LOWINT+00 and CURSOR+00.

In normal operation of the graphics option of the computer system, graphics information to be displayed on the screen is stored in bit map memories 101, 102 and 103. All of the dots which will appear as red are stored in bit map memory 101; all of the dots which appear as green will be stored in bit map memory 102; and all those dots which will appear as blue will be stored in bit map memory 103. By combining red, green and blue, several different colors can be generated in addition to the basic colors. The 8 bit outputs of the bit map memories 101, 102 and 103 are stored in their respective buffers -- buffer A104 for red, buffer A105 for green and buffer A106 for blue. These bytes are, in turn, transmitted to buffer B107 for red, buffer B108 for green and buffer B109 for blue. The data bytes are then applied to shifted 110 for red, shifter 111 for green and shifter 112 for blue; these shifters generate their respective color signals VIDRED+00, VIDGRN+00 and VIDBLU+00 which are then stored in register 113 on the rise of the dot clock signal, DOTCLK+1D. The color output signals VIDRED+1D, VIDGRN+1D and VIDBLU+1D from register 113 are then applied to input address terminals of a read-only memory 123. In addition, the inverse signal INVRSE+00, the low intensity signal LOWINT+00 and video signal VIDEOD+1F are also applied to the input address terminals of ROM 123. Also applied to the input address terminals of ROM 123 is the text-on signal TEXTON+00 (hereinafter also called TEXTON), the palate signal PALATE+00 (hereinafter also called PALATE) and the graphics signal GRAFI+00 which are received from mode register 18 which is loaded via a data bus 21 from main memory 125 under control of the microprocessor 124. The text-on signal TEXTON when high, allows the text received to be displayed on the color CRT 130. The palate signal PATATE+00 selects one of two colors for that text and the graphics signal GRAFIC+1D activates the graphics for display on the color CRT 130. The out signals from ROM 123, REDVIDO+00, GRNVID+00 and BLUVID+00 are then stored in register 126 on the rise of the dot clock signal DOTCLK+1D. The output signals from register 126 REDOUT+00, GRNOUT+00 and BLUOUT+00 are further gated through their respective AND gates 127, 128, 129 when the display enable DSPEND+00 signal is high. The color output signals from AND gates 127, 128, 129, respectively, are REDOUT+1G, GRNOUT+1G and BLUOUT+1G are then displayed on the screen of the color CRT 130. The display enable signal DSPEN8+00 which is generated by the CRTC 116 for a horizontal display time of the beam across the face of the CRT 130 is also stored in register 126 to generate the display enable sigal DSPEND+00.

ROM 123 also generates an attribute video signal ATTVID+00, ATTVID+00 represents the high intensity attribute of the text from ROM 123.

Figure 3:
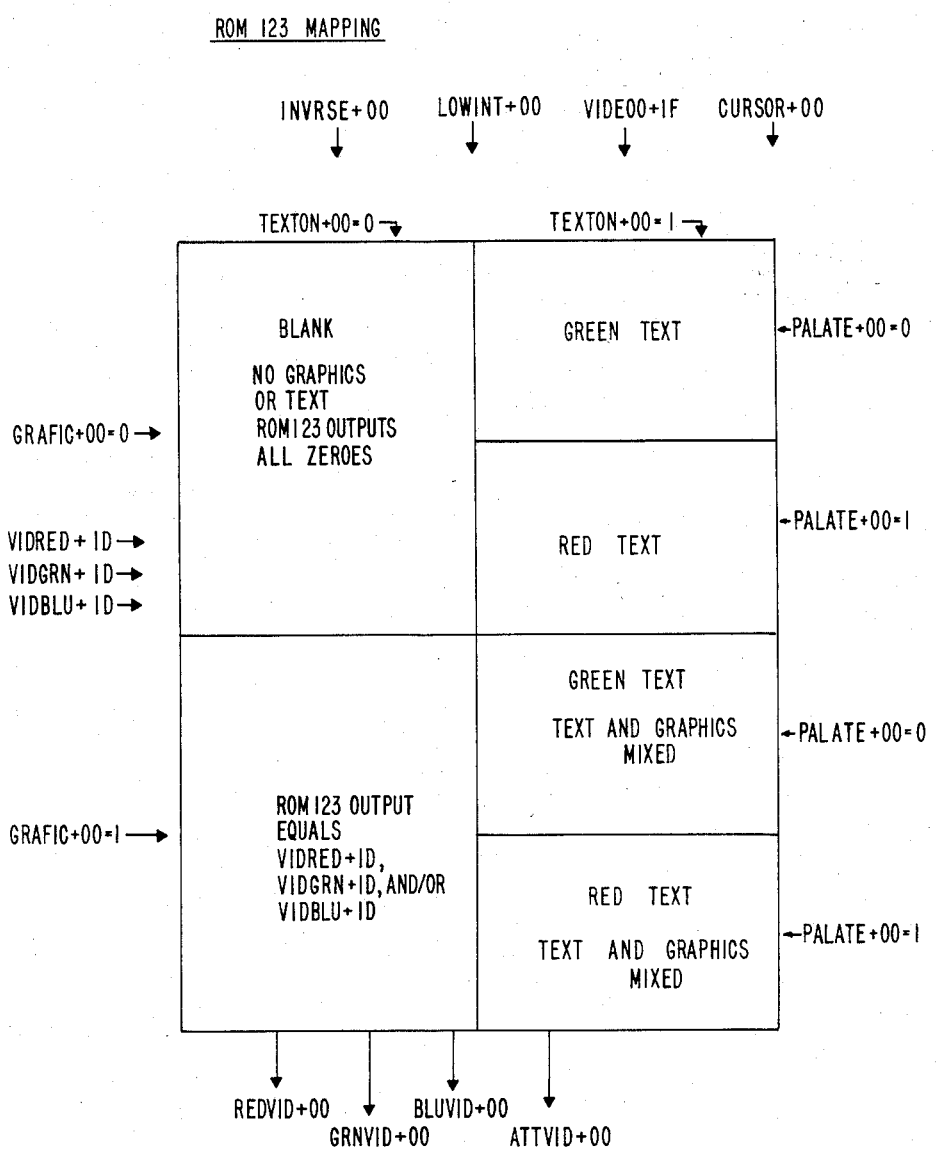
FIG. 3 is a schematic diagram of the color mixing ROM.

Referring now to ROM 123 of FIGS. 2B and 3, when certain address signals applied to ROM 123 are true, the effect of mixing color graphics with monochrome text produces color text which may or may not be mixed with the graphics display. The TEXTON signal selects the text portion of ROM 123; whereas the GRAFIC signal selects the graphics portion. Hence as shown on FIG. 3, when TEXTON signal is ZERO and GRAFIC signal is ZERO, these is no graphics or text displayed. When TEXTON is ONE and GRAFIC is ZERO, either red or green text can be displayed. The selection is done by the PALATE signal. When PALATE is ZERO and TEXTON is one, with GRAFICS equal to ZERO, green text will be displayed. In a similar manner with the above signals set the same, but with PALATE equal to ONE, red text will be displayed.

Text and graphics can further be mixed and presented in selected colors. For example, if the TEXTON signal is ONE and the GRAFIC signal is ONE, green or red text and graphics can be selected depending on whether PALATE is ZERO or ONE. When PALATE is ZERO the text is green and when the PALATE is ONE the text is red with graphics independent of the PALATE signal and being a color represented by the truth table below.

Colors can be mixed by having different combinations of VIDRED, VIDGRN, VIDBLU along with the other signals. Graphics can, therefore, be presented in 8 colors; whereas text can be presented in 4 colors. Each text color may appear as a high intensity of low intensity color.

The following truth table indicates how the 8 colors for graphics are selected for display in response to various signals applied to ROM 123, whereon ONE represents that the signal is true and ZERO represents that the signal is false.

| VIDRED | VIDGRN | VIDBLU | RESULTANT COLOR |
|---|---|---|---|
| 0 | 0 | 0 | Black |
| 0 | 0 | 1 | Blue |
| 0 | 1 | 0 | Green |
| 0 | 1 | 1 | Cyan |

-continued

| VIDRED | VIDGRN | VIDBLU | RESULTANT COLOR |
|---|---|---|---|
| 1 | 0 | 0 | Red |
| 1 | 0 | 1 | Magenta |
| 1 | 1 | 0 | Yellow |
| 1 | 1 | 1 | White |

What is claimed is:

1. A computer display system for displaying color graphics and color alphanumeric text comprising:

a. first means for storing graphic pixels (bits) representative of graphic display images, each image being in a predetermined different color;

b. second means for generating text signals representative of alphanumeric text in monochrome color; and c. third means coupled to said first and second means and jointly responsive to the graphic pixels read out of said first means and to the text signals from said second means for providing binary signals which when applied to a color CRT displays color graphics and color text, and wherein said third means is divided into areas, with some predetermined areas storing binary information representative of text in color, other predetermined areas storing binary information representative of graphics in color, and still other predetermined areas storing binary information representative of color text and graphics mixed, and wherein the binary signals output from said third means are REDVID, GRNVID, and BLUVID.

2. The computer display system as recited in claim 1 including composite means coupled to the output of said third means and responsive to a REDVID binary signal for displaying on a CRT a red color, and also responsive to a GRNVID binary signal for displaying on a CRT a green color, and further responsive to a BLUVID binary signal for displaying on a CRT a blue color.

3. The computer display terminal as recited in claim 2 wherein a predetermined color is generated when a predetermined combination of the REDVID, GRNVID, BLUVID binary signals output from said third means are true in accordance to the following truth table wherein 1 indicates the binary signal is true:

| REDVID | GRNVID | BLUVID | RESULTANT COLOR |
|---|---|---|---|
| 0 | 0 | 0 | Black |
| 0 | 0 | 1 | Blue |
| 0 | 1 | 0 | Green |
| 0 | 1 | 1 | Cyan |
| 1 | 0 | 0 | Red |
| 1 | 0 | 1 | Magenta |
| 1 | 1 | 0 | Yellow |
| 1 | 1 | 1 | White. |

4. The computer display system as recited in claim 3 including fourth means coupled to said third means for generating attribute signals for presentation on a color CRT attributes such as normal, blinking and underscoring.

* * * * *

UNITED STATES PATENT AND TRADEMARK OFFICE

CERTIFICATE OF CORRECTION

PATENT NO. : 4,724,431

DATED : February 9, 1988

INVENTOR(S) : Thomas O. Holtey & Kenneth E. Bruce

It is certified that error appears in the above-identified patent and that said Letters Patent is hereby corrected as shown below:

Claim 1, column 5, line 19, after "the", insert --first binary numbers representing--.

Claim 1, column 5, line 20, after "the", insert --second binary numbers representing--.

Claim 1, column 5, line 21, after "providing", insert --a--.

Claim 1, column 5, line 21, delete "signals" and insert --signal representative of color--.

Claim 1, column 5, line 22, after "CRT", insert --causes the--.

Claim 1, column 5, line 22, delete "displays" and insert --display of--.

Claim 1, column 5, line 26, after "of", insert --colors for the display of--.

Claim 1, column 5, line 26, delete "in color".

Claim 1, column 5, line 27, after "of", insert --colors for the display of--.

Claim 1, column 5, line 29, delete "color" and insert --colors--.

Claim 1, column 5, line 30, before "text", insert --for the display of--.

UNITED STATES PATENT AND TRADEMARK OFFICE

CERTIFICATE OF CORRECTION

PATENT NO. : 4,724,431

DATED : February 9, 1988

INVENTOR(S) : Thomas O. Holtey & Kenneth E. Bruce

It is certified that error appears in the above-identified patent and that said Letters Patent is hereby corrected as shown below:

Claim 1, column 5, lines 30-32, delete ", and wherein the binary signals output from said third means are REDVID, GRNVID, and BLUVID".

Signed and Sealed this

Fourteenth Day of May, 1991

*Attest:*

*Attesting Officer*

HARRY F. MANBECK, JR.

*Commissioner of Patents and Trademarks*